US005447247A

United States Patent [19]

Derksen

[11] Patent Number: 5,447,247

[45] Date of Patent: Sep. 5, 1995

[54] SEALING CAP

[75] Inventor: Klaus Derksen, Karlsbad-Ittersbach, Germany

[73] Assignee: Firma Pohl GmbH & Co. KG, Karlsruhe, Germany

[21] Appl. No.: 957,342

[22] Filed: Oct. 5, 1992

[30] Foreign Application Priority Data

Oct. 4, 1991 [DE] Germany ..... 41 32 896.5

[51] Int. Cl.[6] ..... B65D 41/60

[52] U.S. Cl. ..... 215/247; 215/235; 215/249; 215/274; 220/339

[58] Field of Search ..... 215/235, 247, 249, 251, 215/253, 258, 274, 277, 298, 303, 304; 220/339

[56] References Cited

U.S. PATENT DOCUMENTS

| | | | |
|---|---|---|---|
| 2,395,149 | 2/1946 | Shaw | 215/247 X |
| 3,421,654 | 1/1969 | Hexel | 220/339 X |
| 3,547,297 | 12/1970 | Herbert et al. | 215/249 |
| 4,205,754 | 6/1980 | Nielsen et al. | 215/249 |
| 4,289,234 | 9/1981 | Rutschke | 220/339 X |
| 4,471,879 | 9/1984 | Connor et al. | 215/249 |
| 4,482,071 | 11/1984 | Ishiwatari | 215/255 |
| 4,562,932 | 1/1986 | Finnern | 215/249 |
| 4,664,277 | 5/1987 | Connor | 215/249 |
| 4,723,693 | 2/1988 | DeCoster | 222/483 |
| 4,844,267 | 7/1989 | von Schuckmann | 215/253 |
| 5,016,770 | 5/1991 | Rizzardi | 215/232 |
| 5,080,245 | 1/1992 | Conard | 215/249 |

*Primary Examiner*—Allan N. Shoap
*Assistant Examiner*—Vanessa Caretto
*Attorney, Agent, or Firm*—Kenyon & Kenyon

[57] ABSTRACT

A closure cap for the sterile sealing of a pharmaceutical bottle is disclosed. The bottle is closed with a rubber elastic sealing element that is covered by a flanged cap having a lid region and a flanged border that covers the bottle neck and is connected with the bottle neck in a border zone below the border of the bottle neck. The lid region is covered by a plastic lid and is connected to the plastic lid in its center region at a first attachment area that is enclosed by a partially circular tear line. The plastic lid is provided with a cord-like predetermined bending line. The lid region and the plastic lid are also connected to each other outside the tear line with a second attachment area, and the groove orthogonally intersects an imaginary connection line connecting the centers of the first and second attachment areas.

12 Claims, 9 Drawing Sheets

Fig. 2a
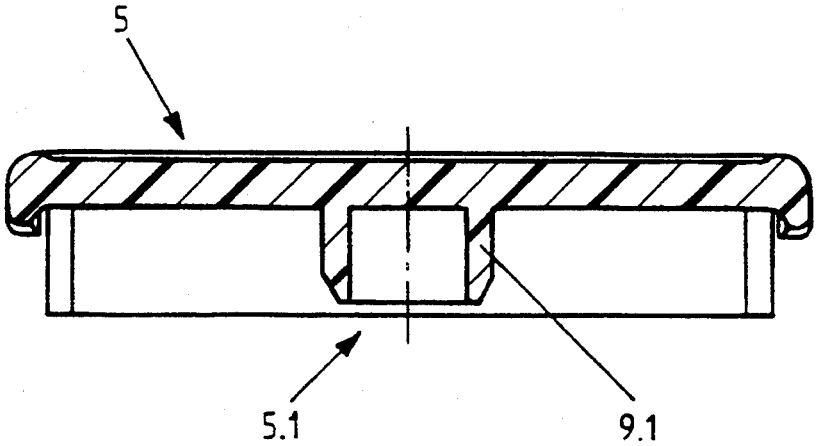
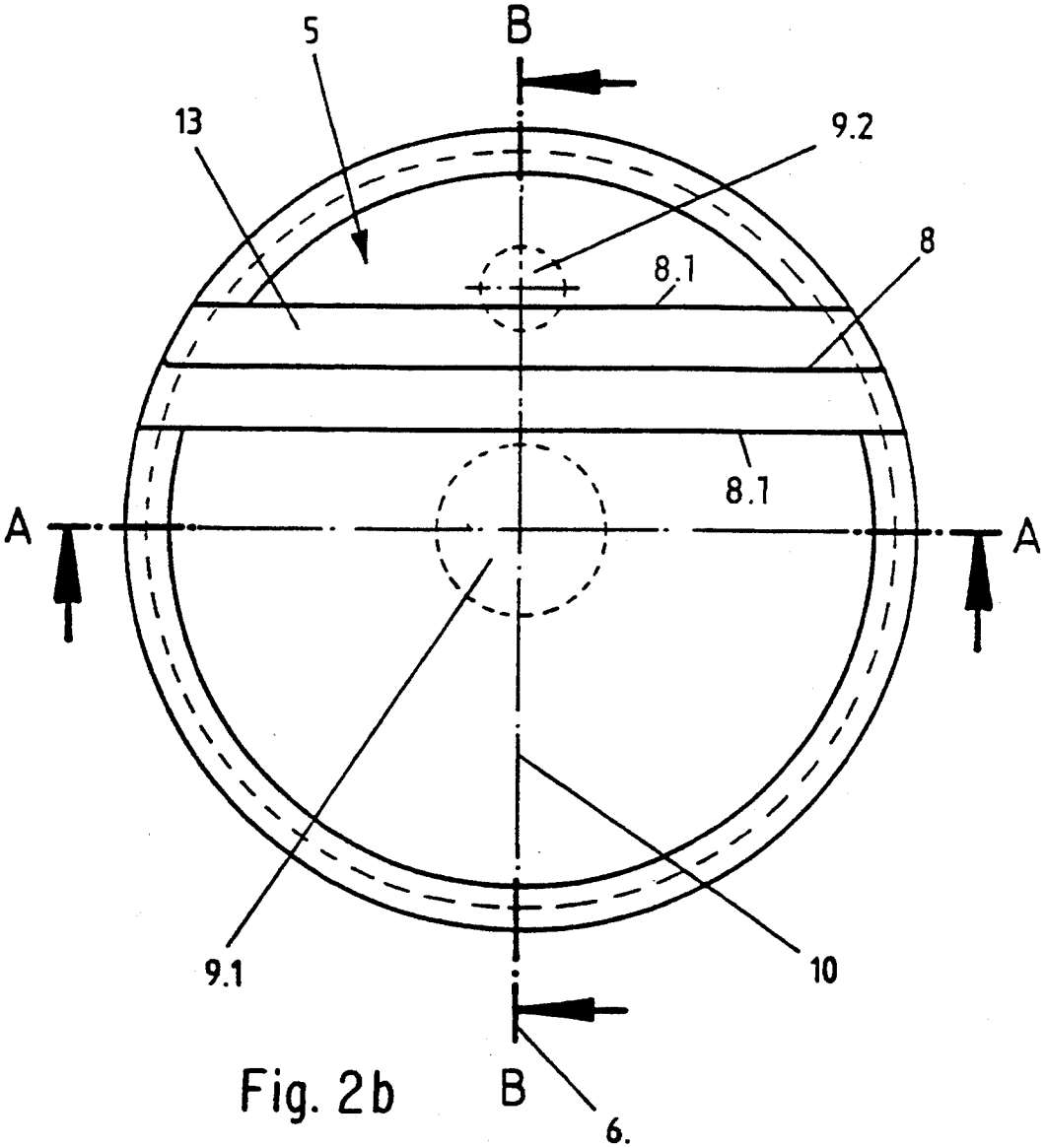
Fig. 2b

Fig. 3a
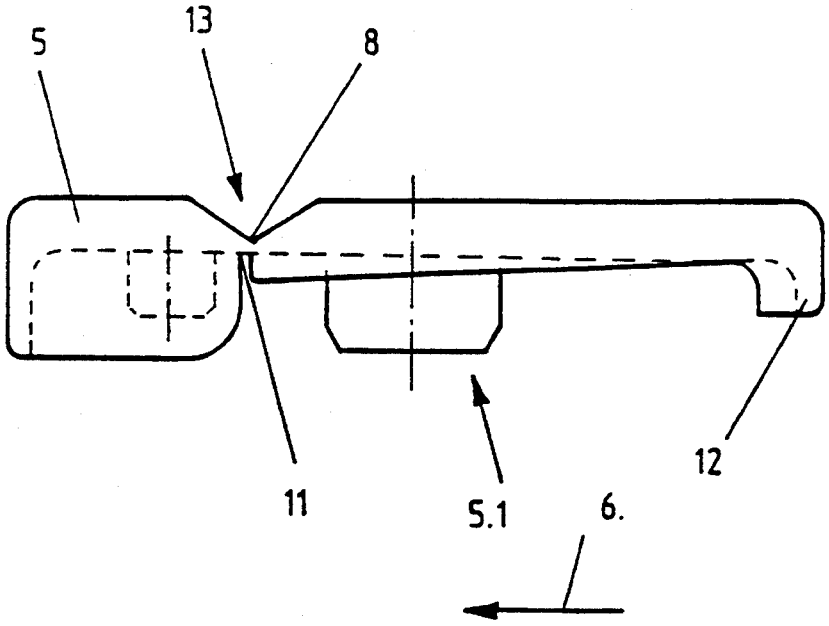
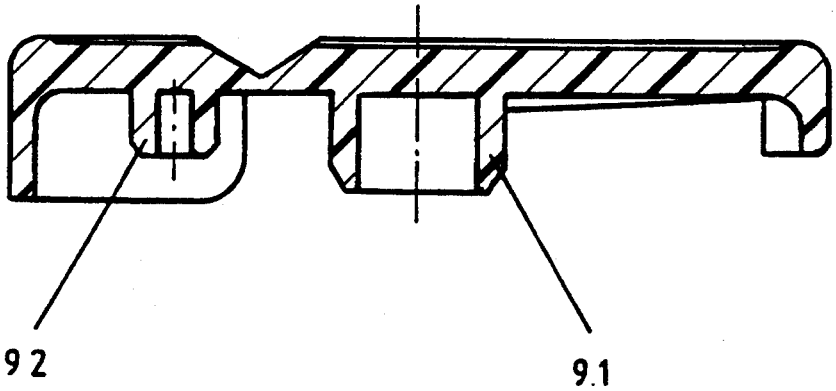
Fig. 3b

SEALING CAP

BACKGROUND OF THE INVENTION

The invention is directed to a closure cap for the sterile sealing of a bottle containing a pharmaceutical agent that has been closed with a rubber elastic sealing element. In such a closure, a flanged cap covers the sealing element with a lid region and covers the bottle neck with a flanged border, and is connected with the bottle neck in a border zone below the border of the bottle neck. The lid region is further covered by a plastic lid and is connected with the plastic lid in its center region along a first attachment area, where the attachment area is enclosed by a circular tear line and where the plastic lid has a diametrically placed predetermined bending line, in which its cross-section is weakened with a groove.

Such a closure cap is known from DE patent 37 15 175, which corresponds to U.S. Pat. No. 4,844,267 (the contents of which are hereby incorporated by reference). The object of this known closure cap for infusion and transfusion bottles is that the closure cap can be removed relatively easily, in spite of a firm connection with the flanged cap. However, in this connection it should be noted that the tear line encloses the center region of the flanged cap in an essentially cylindrical manner, which makes it difficult and complicated to carry out a separation of the bottle, sealing element and flanged cap after use for the purpose of recycling the parts.

SUMMARY OF THE INVENTION

This invention is directed to the problem of further developing a closure cap of the type mentioned above, so that the flanged cap as well as the sealing element and the lid can easily be separated from the glass bottle in order to facilitate the recycling of the bottle. (Such bottles are usually expensive and made of special glass, and therefore well worth recycling.) This invention is further directed to the problem of developing a closure or sealing cap that can easily and reliably be opened with the application of only small amounts of force, even when used with small bottle diameters of less than 20 mm, without the risk that the entire flanged cap will be unintentionally torn off the bottle neck.

This is accomplished with a closure cap made of two principal parts, an underlying flanged cap, and an overlying plastic lid. The flanged cap in turn is made of two main elements, a flat lid region, and a circumscribing dependent flanged portion. The underlying lid region of the flanged cap and the overlying plastic lid are connected to one another at two attachment regions. In these regions, a portion of the plastic lid extends downwardly from the plastic cap and mechanically interlocks with a corresponding hole in the underlying lid region. A tear line running through the flanged cap adjacent the attachment regions enables the flanged cap to be torn as needed. The plastic lid is provided with a bending groove, about which the lid pivots when raised, and which orthogonally intersects an imaginary line connecting the first and second attachment areas. The tear line is interrupted in the region of the bending groove.

It is further advantageous that the closure cap provide a germ-free seal between the plastic lid and the flanged cap even at small bottle diameters. The plastic lid is arranged to cooperate with the lid surface so as not to rotate. With a minimum of effort, one may raise this plastic lid, thereby exposing the underlying rubber elastic sealing element in the center region. The liquid can then be taken from the bottle with a syringe inserted through the exposed center of the lid region. The unintentional further tearing off of the flanged cap is reliably prevented by means of the tear line, which does not close in on itself, the provision of a predetermined bending line, as well as the second attachment area of the plastic lid arranged behind the predetermined bending area in the opening direction.

If desired, the closure cap can be completely removed from the bottle in a second step by further lifting the plastic lid from the lid region in the opening direction. This step requires comparatively little additional force, since the plastic lid acts as a lever to facilitate tearing off the complete tear-off part. The removal of the plastic lid from the bottle neck thus provides both the lid region and the flanged border of the flanged cap, which is made of aluminum, with a wedge-shaped clearance, extending from the center of the lid region into the lower region of the flanged border. This clearance enables one to easily remove the flanged cap to enable one to remove the rubber elastic sealing element typically provided for the sterile sealing of the bottle.

The bending groove is oriented so that the top of the "V" shape defined by its cross-section lies along the top of the plastic lid. It is advantageous that the predetermined bending groove or line be readily visible to the user of the bottle so that he may proceed to easily lift the plastic lid. Furthermore, it is provided that the bending groove have a V-shaped cross-section, and that the groove be delimited by flank surfaces forming an angle of at least 85° and at most 150°. The angle formed by these flank surfaces preferably lies in the range of 100° to 135°. The preferred obtuse angle formation of the V-shaped groove is particularly advantageous if the pharmaceutical contents of the bottle are not meant to be removed by complete removal of the closure cap, but rather through a syringe, for example, which penetrates the center opening of the lid region and the rubber elastic sealing element. The front part of plastic lid in the opening direction, which is pivoted away from the bottle, does not form a hindrance to withdrawal of the liquid, since it leaves the center region of the flanged cap exposed.

The plastic lid can have a surface which is circularly delimited. This makes it possible to simply produce such plastic lids as well as to seal bottles with pharmaceutical contents in filling machines. In addition, the filled bottles can be stored in a small amount of space.

The plastic lid can be configured to at least partially cover the flanged border of the flanged cap, allowing for an interruption of this coverage in the region of the groove by means of cut away portions or clearances. The clearances in the coverage extend into the region of the inside surface of the plastic lid. This helps further reduce the force required to expose the center clearance of the lid region of the flanged cap. This has the concurrent benefit of further reducing the danger that the entire flanged cap be unintentionally torn off, which is slight in any case. Also, to further facilitate handling, an opening tab can be integrally molded onto the plastic lid.

The tear line running through the lid region of the flanged cap can be provided with an extension parallel to the imaginary connection line at least along one side of the connection line; this extension preferably extends beyond the second attachment area into the region of the flanged border. This structure guarantees that the entire flanged cap can be torn off in a simple and targeted manner.

In another embodiment which further facilitates the removal of the flanged cap, the tear line comprises two line extensions that continue along both sides of the second attachment area. In order to completely remove the flanged cap, the tear-off part is separated from the flanged cap in the opening direction. This essentially straight-line movement rapidly opens the closure cap. The use of such a flanged cap is possible without problems even for bottle diameters of less than 20 mm.

BRIEF DESCRIPTION OF THE DRAWINGS

FIGS. 2*a* and 2*b* show the plastic lid of FIG. 1 in a top plan view (FIG. 2*b*) and a cross-sectional view taken along the line A—A (FIG. 2*a*).

FIGS. 3*a* and 3*b* show the plastic lid of the closure cap according to the invention in a side view and in cross-section.

FIGS. 4*a* and 4*b* illustrate an alternative embodiment of the flanged cap, in which FIG. 4*a* illustrates a side view of the flanged portion of the cap partially in section, and FIG. 4*b* illustrates the lid region of the flanged cap in top plan view.

FIGS. 5*a* and 5*b* illustrate an alternative embodiment of the flanged cap, in which FIG. 5*a* illustrates a side view of the flanged portion of the cap partially in section, and FIG. 5*b* illustrates the lid region of the flanged cap in top plan view.

FIGS. 6*a* and 6*b* illustrate an alternative embodiment of the flanged cap, in which FIG. 6*a* illustrates a side view of the flanged portion of the cap partially in section, and FIG. 6*b* illustrates the lid region of the flanged cap in top plan view.

DETAILED DESCRIPTION

Figure 1A:
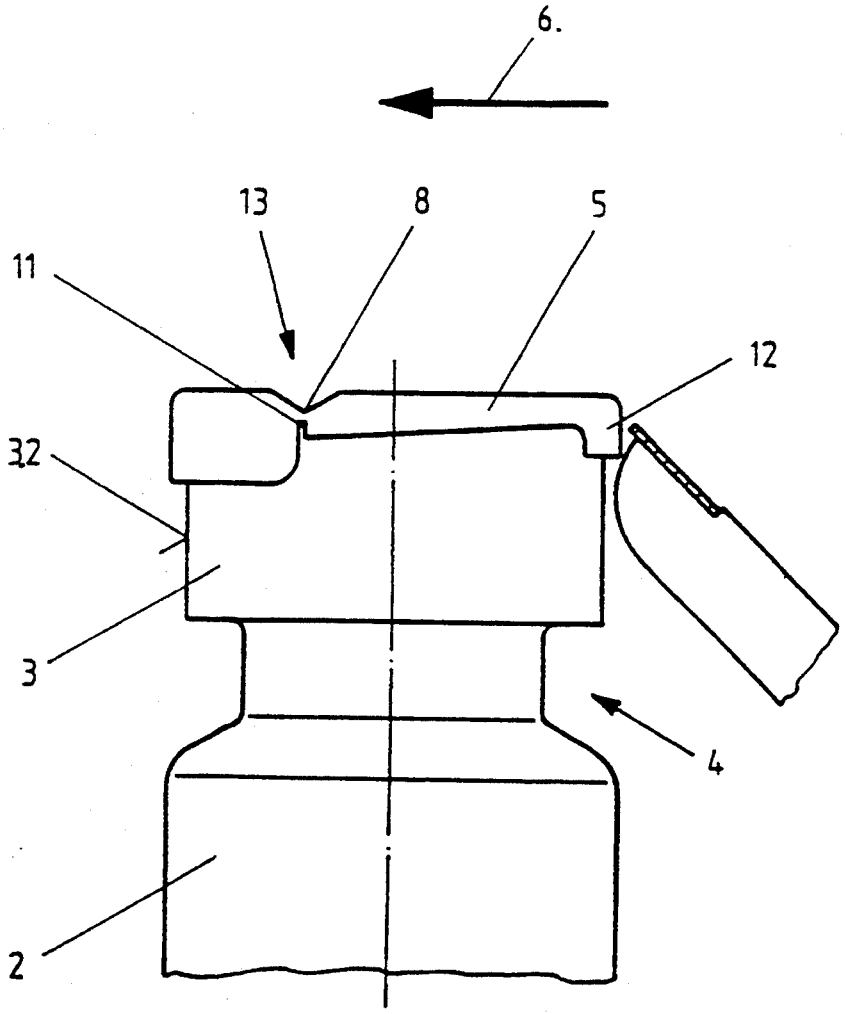
FIG. 1*a* shows a side view of a bottle sealed with the closure cap constructed according to the invention.
Figure 1B:
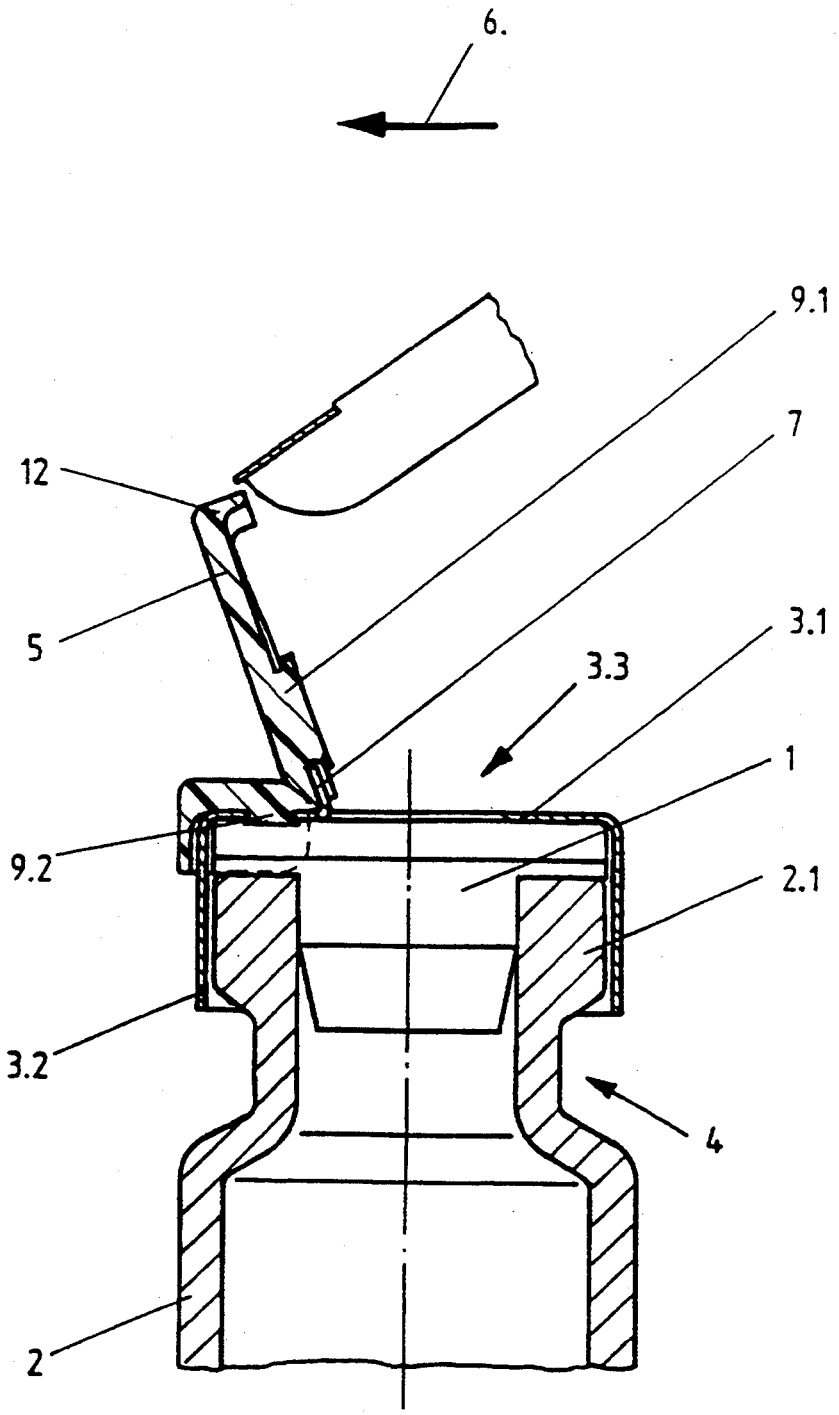
FIG. 1*b* illustrates in cross-section the bottle after the plastic lid has been raised so as to provide a degree of access to the underlying sealing element.

FIG. 1*a* shows a closure cap, which is arranged on the bottle neck 2.1 of a bottle containing a pharmaceutical product. Inside the bottle neck 2.1, a sealing element 1 made of rubber elastic material is arranged, which seals off the opening of the bottle. The closure cap comprises a flanged cap 3 made of aluminum sheet, which covers the sealing element 1 with a lid region 3.1 and covers the bottle neck 2.1 with a flanged border 3.2. The flanged cap 3 is fixed in place on the bottle neck 2.1 in the region of the border zone 4, which is formed as a constriction in the bottle. The lid region 3.1 has a centrally arranged center opening 3.3 (FIG. 1*b*). The overlying plastic lid 5 has a correspondingly protruding region 5.1 integrally molded onto the plastic lid 5 that is configured to protrude into an opening in the lid region. The plastic lid 5 is also provided with a groove 13 that includes a predetermined bending line 8, so that the lid can be opened by the operator without requiring much force. The lid 5 may further be provided with an opening tab 12 to facilitate handling by the user.

Figure 4A:
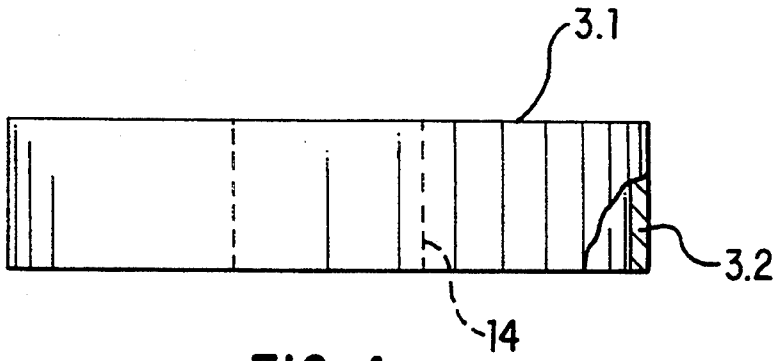
Figure 4B:
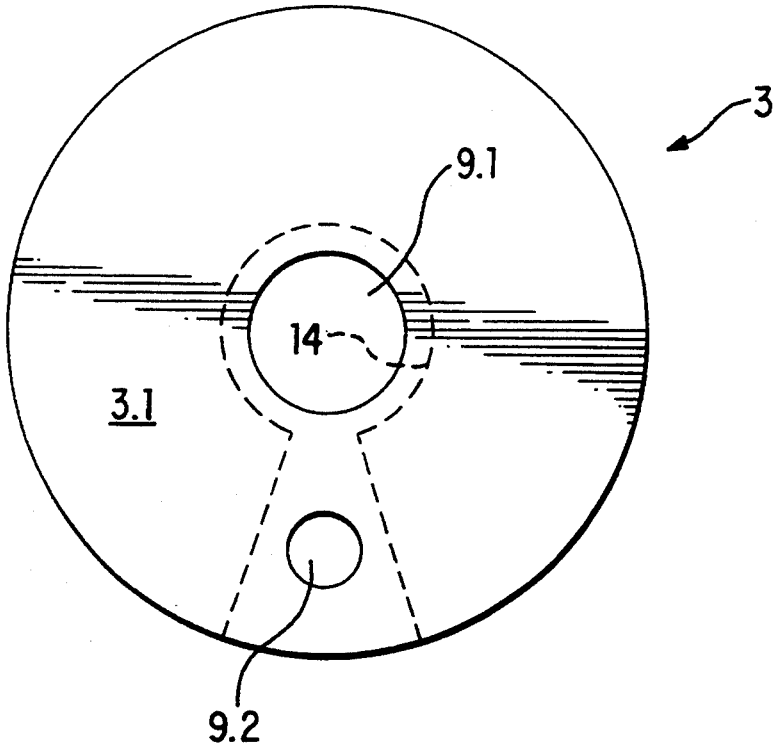

The operation of the closure cap for infusion, transfusion or other medicinal bottles 2 proceeds along two steps. In a first opening operation, shown in FIG. 1*b*, the plastic lid 5, the center region 5.1 of which engages with and extends below the lid region of the flanged cap 3, is first raised so that the sealing element 1 arranged below the center opening 3.3 is exposed. The plastic lid 5 is pivoted upwardly until the delimitation lines 8.1 about the predetermined bending line 8 lie against one another (FIG. 1*b*). In order to facilitate the opening of the plastic lid, cut out portions 11 are provided along the lid periphery where the bending line 8 meets the periphery of the lid. At this orientation, and depending on the angle of the bending line in cross-section, the raised portion of the plastic lid 5 forms an angle of 110° with respect to the lid surface 3.1. The center opening 3.3 of the flanged cap 3 and the underlying rubber elastic sealing element 1 are then readily accessible. Very slight forces are required to expose the center opening 3.3, provided the plastic lid 5 has a reduced material thickness in the region of the predetermined bending line 8. The plastic lid 5 is connected to the underlying cap with a tear-off part 7, which is delimited with respect to the remainder of the cap by perforations defining a tear line (which may be interrupted in the region of the bending groove). These perforations will generally extend past the center region 5.1 and the first attachment area 9.1 (see FIGS. 4–6). In the opening direction 6 and radially behind the first attachment area 9.1 of the plastic lid 5 lies a second attachment area 9.2, which engages the underlying lid through a further opening in the lid region 3.1. In FIG. 1*b*, the flanged cap 3 still holds the rubber elastic sealing element 1 firmly in place on the bottle 2. The fluid can be taken from the bottle 2 with a syringe, for example, through the sealing element 1, through the center clearance 3.3 in the lid region 3.1 and the sealing element 1 which is thereby exposed.

FIG. 2 shows a top view of the plastic lid 5, as well as a cross-section of the plastic lid along the line A—A. The predetermined bending line 8 is located in the opening direction 6 between the center region 5.1 and the second attachment point 9.2 arranged radially behind it. The predetermined bending line, which forms the base of the groove of the V-shaped recess, is arranged further in the direction of the second attachment point 9.2. This results in a greater lever effect with regard to opening the center clearance 3.3 under the center region 5.1. As seen in FIG. 2B, the first and second attachment areas lie along an imaginary line 10 that is orthogonal to the bending line 8.

Figure 1C:
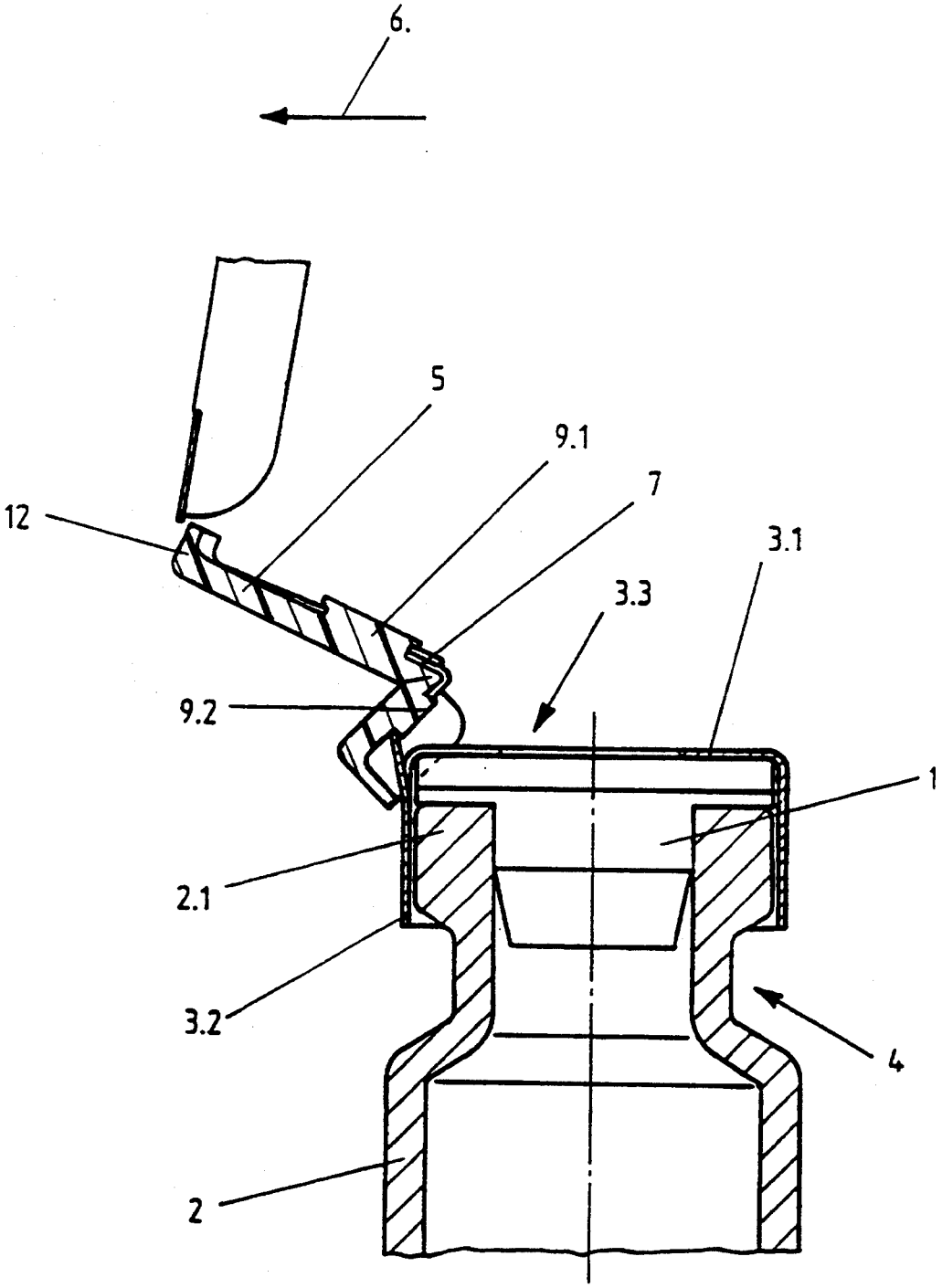
FIG. 1*c* illustrates in cross-section the bottle of FIG. 1*b* as the cap is being removed.
Figure 1D:
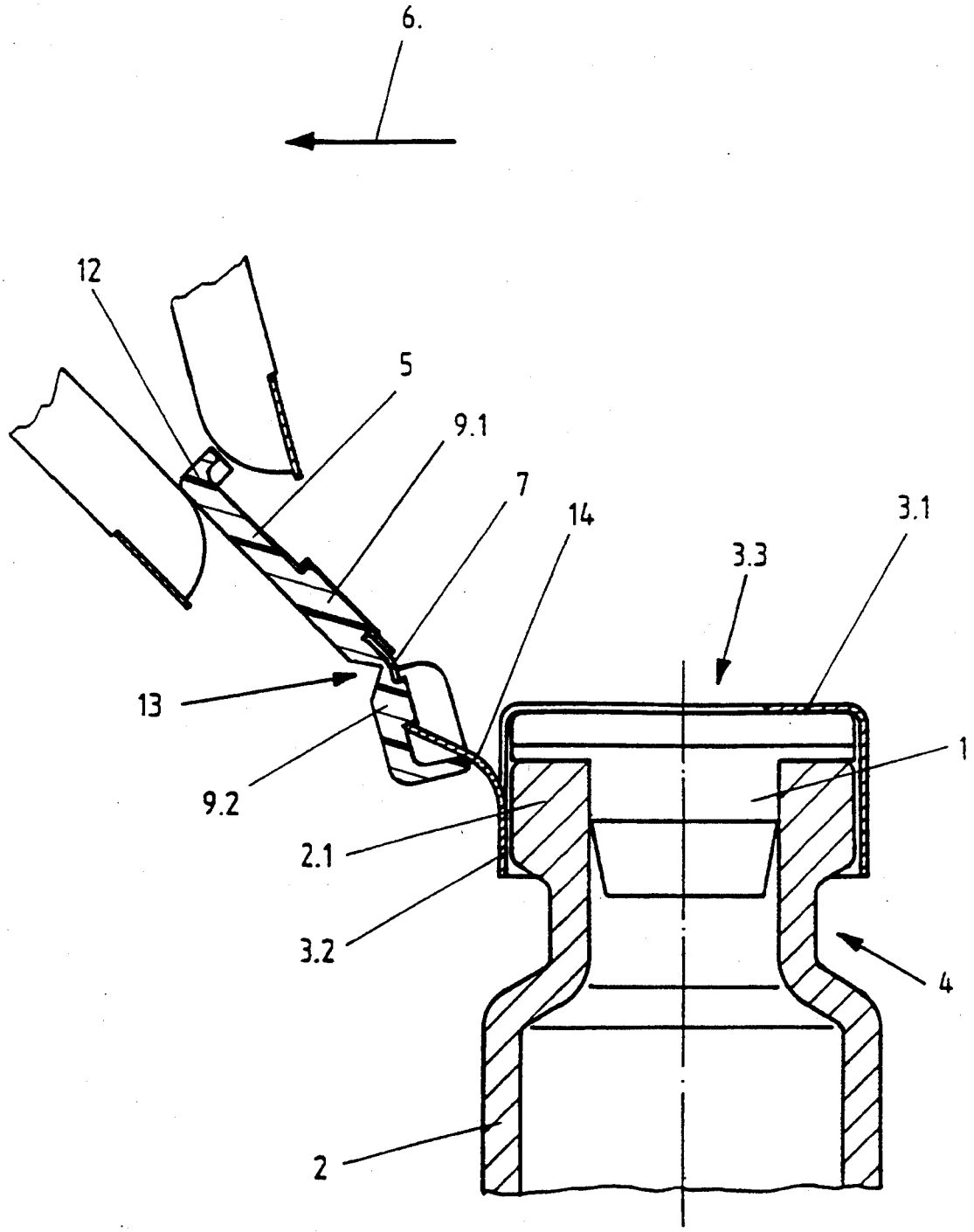
FIG. 1*d* illustrates further removal of the plastic cap and the tearing of the flanged cap.

FIGS. 3*a* and 3*b* show a side view of the plastic lid 5 shown in FIG. 2, from the left, and a cross-section along the line B—B. The second attachment point 9.2 is seen to have a lesser diameter as compared with the first attachment point 9.1. The rear delimitation, which partially covers the flanged border 3.2 of the flanged cap, is utilized as a further lever to completely tear off the closure cap, as shown in FIGS. 1*c* and 1*d*.

In some emergency situations, it may be desirable to directly remove the entire closure cap in order to be able to pour out the contents of the glass bottle 2. Furthermore, it is desirable for economic and environmental reasons for the glass bottle, which is usually made of high-quality, expensive glass, to be recyclable. Recycling of the glass bottle 2, however, is only possible if the aluminum flanged cap 3 and the rubber elastic sealing element 1 are first removed. The second operational step for effecting the complete removal of the closure cap is shown in FIGS. 1*c* and 1*d*. (FIG. 1*d* shows the closure cap just before complete removal from the bottle neck 2.1.)

Figure 5A:
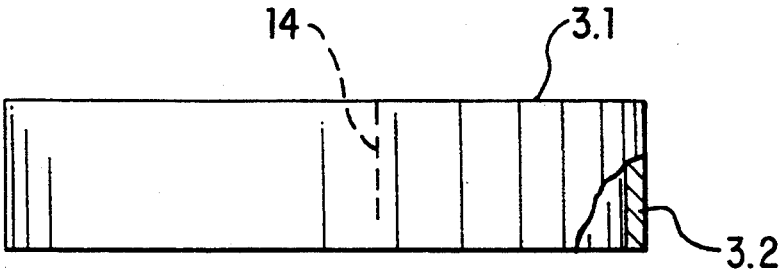
Figure 5B:
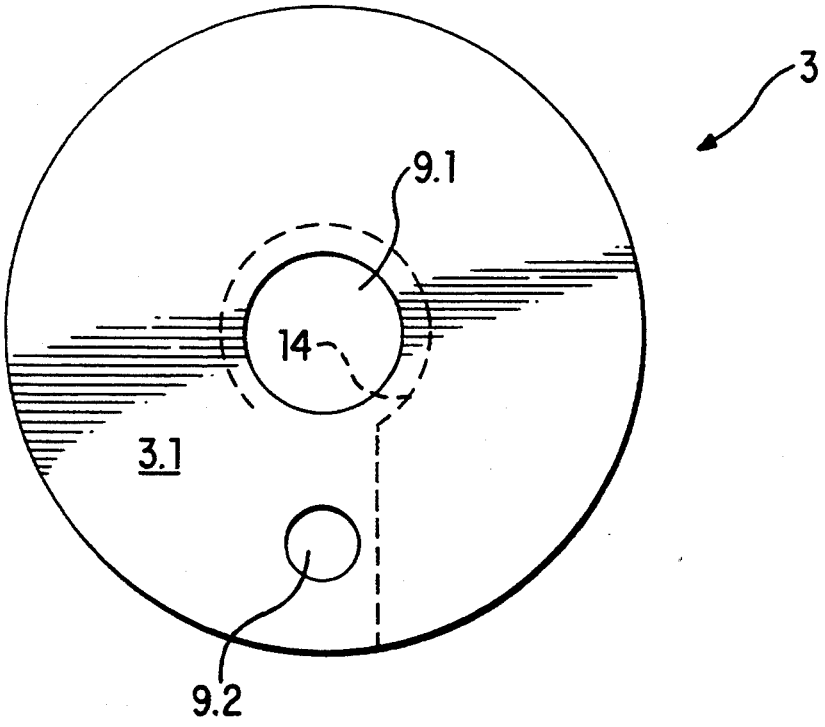
Figure 6A:
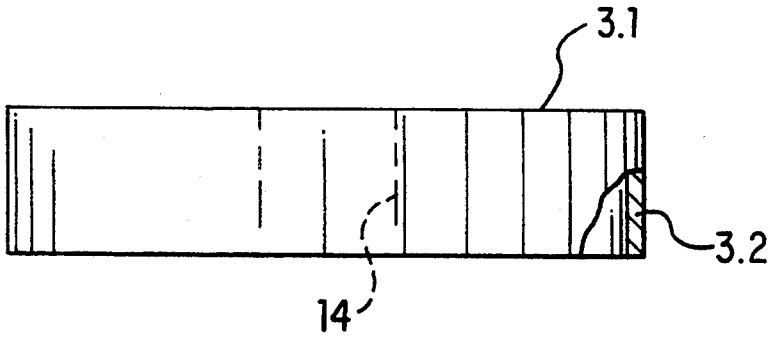
Figure 6B:
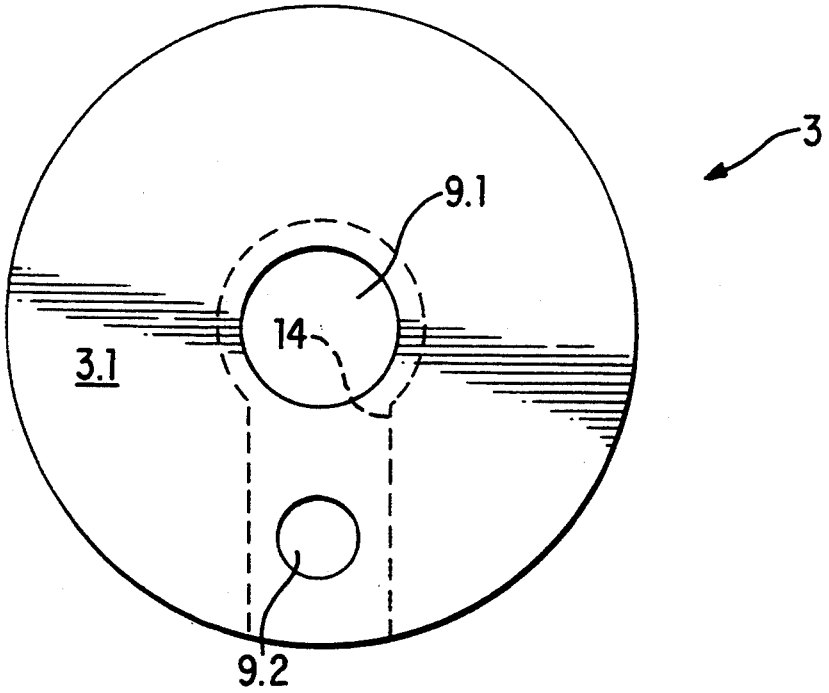

The initial position is shown in FIG. 1*b*, in which the second attachment area 9.2 is seen to comprise the junction of an opening in the lid surface 3.1 and a downwardly extending projection of the plastic lid 5. The projection engages through and below the underlying lid opening in a manner similar to that in the region of the first attachment area 9.1. If the plastic lid 5 is moved further in the opening direction 6, proceeding from FIG. 1*b*, with slightly greater exertion of force, the tear-off part 7 continues to tear along the defined tear line 14, across the lid surface 3.1 and continuing into the flange border 3.2, as shown in FIG. 1*c*. The tear line 14 can be structured in a number of different ways; however, in each embodiment the perforation about the center region 5.1 should not be formed as a circular cylinder that completely closes in on itself in a circular fashion. Within the scope of the present invention, the tear line 14 preferably extends essentially in a radial direction from the center point of the lid region 3.1, past the second attachment area 9.2, into the region of the lower flanged border 3.2 (see FIGS. 4*a* and 4*b*). This results in a wedge-shaped opening in the flanged-cap 3, proceeding from the center clearance 3.3 into the lower region of the flanged border 3.2. FIGS. 5*a* and 5*b* show an alternative embodiment, in which only one tear line extends to the edge of the lid and down the flange. In the embodiment shown in FIGS. 6*a* and 6*b*, the perforation extends in parallel rows past the second attachment area.

What is claimed is:

1. A closure cap for providing a seal to a pharmaceutical bottle having an opening, a neck, and a rubber elastic sealing element, comprising:

a) a flanged cap overlying the sealing element, said flanged cap having i) a disk-shaped lid region having first and second non-overlapping attachment areas at least partially bordered by a partially arcuate tear line in the lid region, and ii) a flanged border region downwardly dependant from the lid region and shaped to provide attachment of the flanged cap with the neck region of the pharmaceutical bottle; and b) a plastic lid having a top surface, said plastic lid i) overlying and attached to the flanged cap, said plastic lid being connected to the lid region of the flanged cap at said first and second attachment areas, said first attachment area being partially delimited by said tear line, and ii) said plastic lid further having a groove extending across the top surface of the plastic lid so as to constitute a hinge through which that portion of the plastic lid lying on one side of the groove can be bent with respect to the portion of the plastic lid lying on the other side of the groove, said groove being orthogonal to an imaginary line that passes through the first and second attachment areas.

2. The closure cap according to claim 1, wherein the groove opens towards the top of the plastic lid.

3. The closure cap according to claim 1, wherein the groove has a V-shaped cross-section.

4. The closure cap according to claim 3, wherein the groove is delimited by flank surfaces which form an angle of at least 85° and at most 150° with one another.

5. The closure cap according to claim 4, wherein the angle is 100° to 135°.

6. The closure cap according to claim 1, wherein the plastic lid has a generally circular peripheral portion.

7. The closure cap according to claim 1, wherein the plastic lid at least partially covers the flanged border of the flanged cap, said coverage provided by said plastic lid being interrupted where the periphery of the plastic lid lies adjacent the groove.

8. The closure cap according to claim 1, wherein the plastic lid is provided with an opening tab molded onto the plastic lid.

9. The closure cap according to claim 1, wherein the tear line extends generally parallel to the imaginary line.

10. The closure cap according to claim 9, wherein the tear line further extends beyond the second attachment point into the region of the flanged border.

11. The closure cap according to claim 1, wherein the tear line terminates in two extensions that lie along both sides of the second attachment area.

12. The closure cap according to claim 1, wherein the tear line does not extend around a portion of said first attachment area that lies nearest the groove.

* * * * *